US005566539A

United States Patent [19]

Binder et al.

[11] Patent Number: 5,566,539

[45] Date of Patent: Oct. 22, 1996

[54] METHOD AND APPARATUS FOR REPAIRING A YARN BREAKAGE IN A PAIR OF SPINNING UNITS

[76] Inventors: Rolf Binder, Schauenbergstrasse 3, CH-8353 Raterschen; Martin Witschi, Bachtelstrasse 24, CH-8200 Schaffhausen, both of Switzerland

[21] Appl. No.: 95,654

[22] Filed: Jul. 21, 1993

Related U.S. Application Data

[63] Continuation-in-part of Ser. No. 728,555, Jul. 11, 1991, Pat. No. 5,313,773, Ser. No. 878,496, May 5, 1992, Pat. No. 5,237,810, Ser. No. 919,876, Jul. 27, 1992, abandoned, and Ser. No. 986,595, Dec. 7, 1992, Pat. No. 5,339,614.

[30] Foreign Application Priority Data

Jul. 23, 1992 [CH] Switzerland ..... 02323/92

[51] Int. Cl.[6] ..... D01H 11/00; D01H 13/04

[52] U.S. Cl. ..... 57/261; 57/279; 57/280

[58] Field of Search ..... 57/261, 279, 280, 57/289, 328

[56] References Cited

U.S. PATENT DOCUMENTS

| | | | |
|---|---|---|---|
| 2,772,054 | 11/1956 | Herele et al. | 242/18 X |
| 3,306,020 | 2/1967 | Rosenstein | 57/22 |
| 3,379,002 | 4/1968 | Rosenstein | 57/22 X |
| 3,924,393 | 12/1975 | Stahlecker et al. | 57/34 R |
| 3,962,855 | 6/1976 | Stahlecker | 57/34 R |
| 4,489,544 | 12/1984 | Morita et al. | 57/261 |
| 4,506,498 | 3/1985 | Lamb | 57/87 |
| 4,576,342 | 3/1986 | Schwengeler | 242/36 |
| 4,581,881 | 4/1986 | Lamb | 57/87 |
| 4,854,523 | 8/1989 | Stahlecker et al. | 242/166 |
| 4,972,667 | 11/1990 | Oeggerli | 57/84 |
| 5,016,432 | 5/1991 | Stahlecker | 57/328 X |
| 5,067,315 | 11/1991 | Stahlecker | 57/328 |
| 5,109,662 | 5/1992 | Inger | 57/305 |
| 5,155,987 | 10/1992 | Vogel | 57/22 |
| 5,163,279 | 11/1992 | Stahlecker | 57/261 X |
| 5,167,114 | 12/1992 | Stahlecker | 57/328 X |
| 5,175,982 | 1/1993 | Stahlecker | 57/261 |
| 5,235,800 | 8/1993 | Slavik et al. | 57/264 |
| 5,313,775 | 5/1994 | Binder et al. | 57/261 X |

*Primary Examiner*—William Stryjewski

[57] ABSTRACT

Two parallel spun yarns (8, 8*a*) are wound onto a joint cross-wound bobbin (15) in the machine. If one of the yarns breaks (e.g. 8), the bobbin (15) and the supply of slivers (32, 32*a*) to the drafting arrangements (11, 11*a*) are stopped. An end of the unbroken yarn (8*a*) is taken up by a suction tube (69) and the broken end of the yarn (8) is wound up on the bobbin (15). The ends of the two yarns (8, 8*a*) are retrieved, reversely routed through the spinning units (12, 12*a*), the bobbin (15) and the draw-off device (14) are restarted and, the yarns (8, 8*a*) are deposited in and simultaneously withdrawn from the drafting arrangements (11, 11*a*) for joining therein with the end of restarted slivers (32, 32*a*). The sliver stoppers (30, 30*a*), however, are restarted at different times. In this manner, repair of a breakage in two yarns being jointly wound up on a common bobbin is achieved. During a subsequent twisting of the two yarns (8, 8*a*) to form a thread, the joined positions of the two yarns are offset along their lengths with respect to one another.

13 Claims, 3 Drawing Sheets

METHOD AND APPARATUS FOR REPAIRING A YARN BREAKAGE IN A PAIR OF SPINNING UNITS

CROSS-REFERENCE TO RELATED APPLICATIONS

This is a continuation-in-part of U.S. application Ser. No. 07/728,555 filed Jul. 11, 1941, now issued as U.S. Pat. No. 5,313,773, for Apparatus and Method For Automatic Thread Joining And Cleaning In A Spinning Machine and a continuation-in-part of U.S. application Ser. No. 07/878,496 filed May 5, 1992, now issued as U.S. Pat. No. 5,237,810, for Method And Apparatus For False Twisting Spinning and a continuation-in-part of U.S application Ser. No. 07/919, 876 filed Jul. 27, 1992, now abandoned for Method For Controlling Processing Cycles Occurring Between An Automatic Service Robot And A Spinning Position In A Textile Machine and a continuation-in-part of U.S. application Ser. No. 07/986,595, filed Dec. 7, 1992, now issued as U.S. Pat. No. 5,339,614, for Apparatus for Separating And Processing The End Of A Yarn. The disclosures of all of the foregoing are incorporated by reference herein.

BACKGROUND OF THE INVENTION

From U.S. Pat. No. 4,854,523 it is known to arrange the spinning units in pairs in a yarn spinning machine, e.g. a pair of air jet spinning nozzles, and to jointly wind up the separate yarns being spun onto a joint bobbin. This method is preferable if the two yarns are to be subsequently twisted, because a rewinding can be avoided thereby. False twist yarns produced with air jet spinning nozzles are well suited for subsequent twisting. Twisted false twist yarns are nearly equivalent to twisted ring spinning yarns with respect to quality and can be produced substantially less expensively.

Automatic service robots are known (e.g. EP 417 662) for automatically repairing yarn breakages or otherwise restarting spinning operations in air jet spinning machines. These known automatic operating devices cannot be used in spinning machines according to U.S. Pat. No. 4,854,523 without implementing additional measures.

SUMMARY OF THE INVENTION

The present invention provides a method and a spinning machine which enables a yarn breakage to be repaired even in separately spun yarns which are wound up in pairs.

BRIEF DESCRIPTION OF THE DRAWINGS

Exemplary embodiments of the invention are described in detail below with reference to the accompanying drawings, wherein.

DETAILED DESCRIPTION OF PREFERRED EMBODIMENTS

Figure 1:
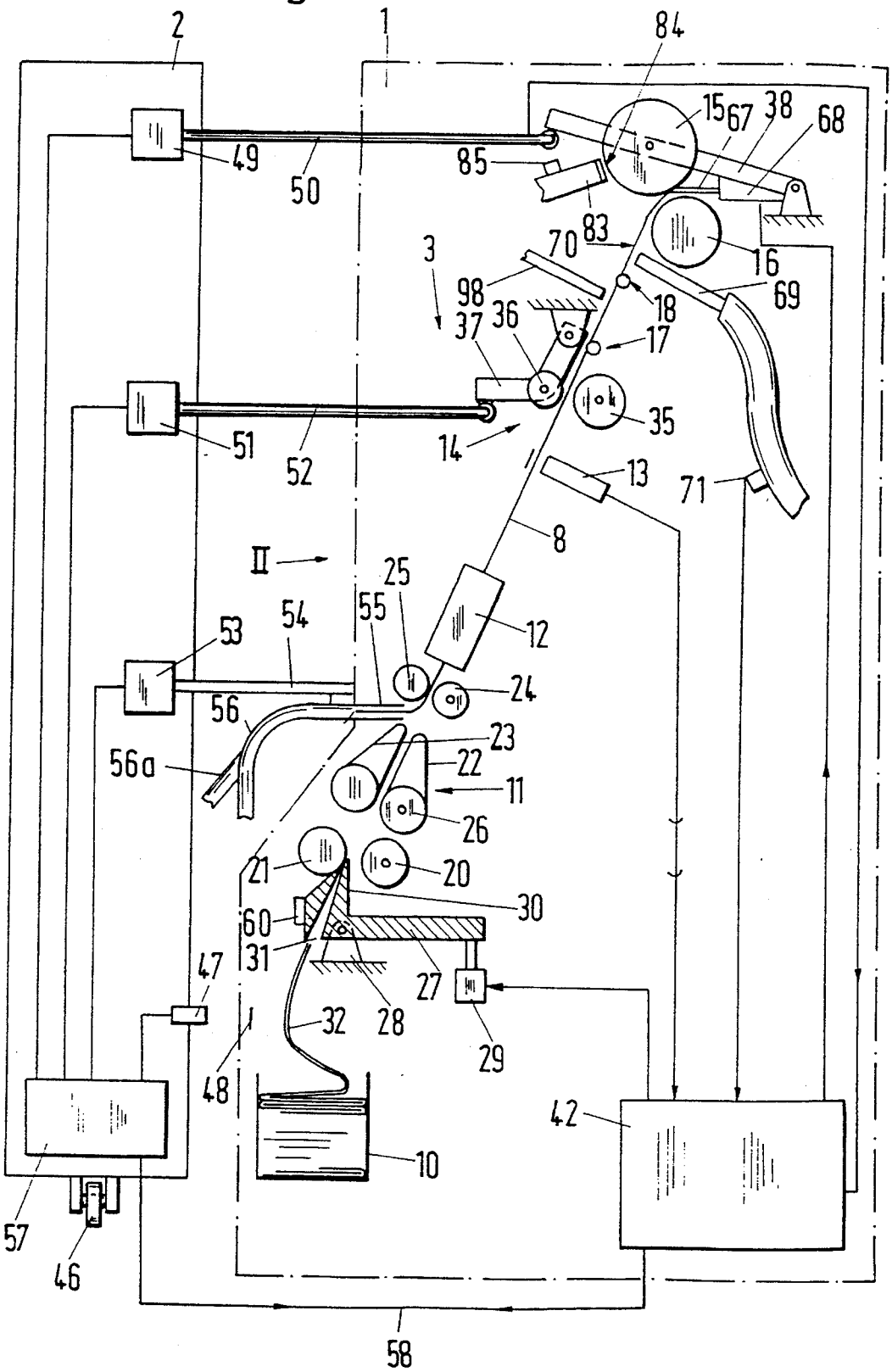
FIG. 1 is a schematic side cross-sectional view of an air jet spinning station with an automatic servicing robot positioned at the station.
Figure 2:
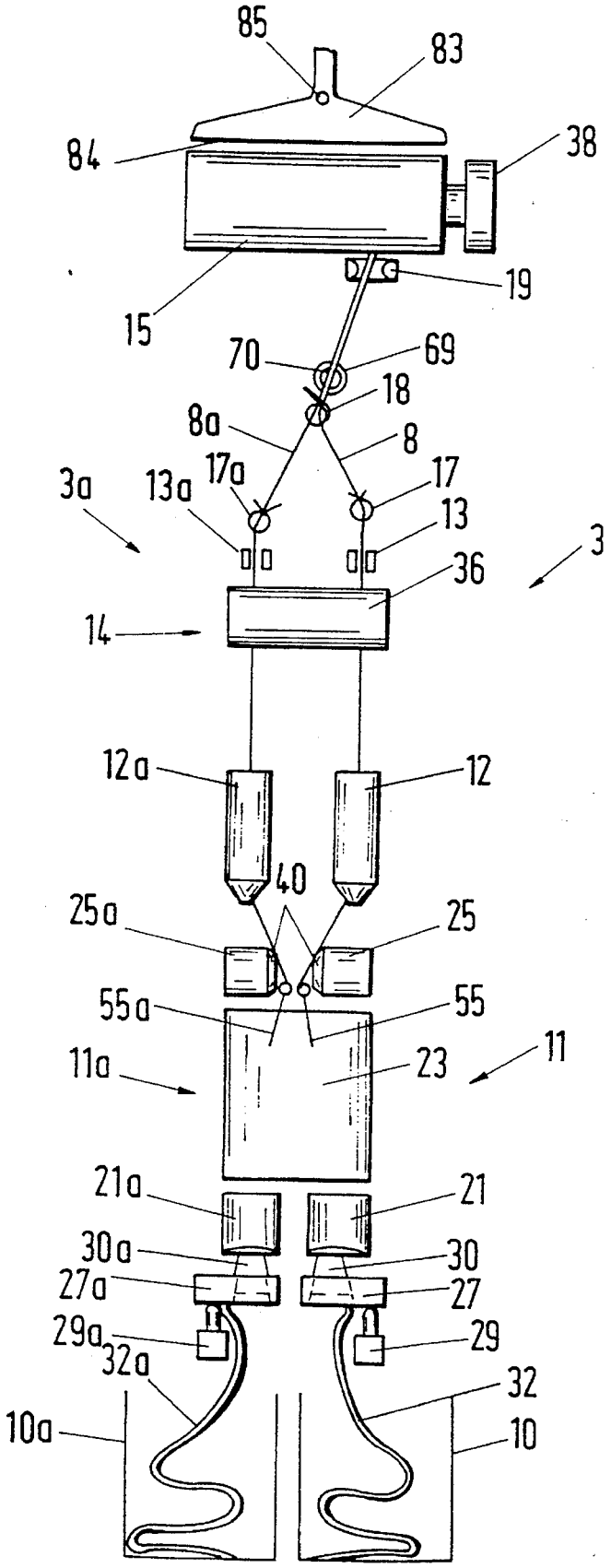
FIG. 2 is a front schematic view in the direction of arrow II in FIG. 1 showing the spinning station of FIG. 1 in concert with an identical immediately adjacent, jointly operating spinning station.

FIG. 1 schematically shows a side cross section through a spinning station in an air jet spinning machine 1 with an automatic service robot stationed in position for servicing a pair of spinning stations 3, 3*a*, FIG. 2. Machine 1 comprises a large number of identical pairs of spinning units 3, 3*a*, arranged adjacent to one another side by side along the length of machine 1, FIG. 2. The two spinning units 3, 3*a* of each pair are each allocated a sliver container 10,10*a* and comprise (as seen in the direction of the yarn course) two drafting mechanisms 11, 11*a*, two air vortex nozzles 12, 12*a* for separately spinning the sliver supplies 32, 32*a* into two separate yarns 8, 8*a*, a joint draw-off unit 14 and a joint winding bobbin 15 which is carried by a conventional bobbin holder or pivotable lever 38 which rests on a friction roller 16 during normal operation.

The drafting mechanisms 11, 11*a* of the jointly operating pair of stations are arranged according to EP 488 007, for example, (the disclosure of which is incorporated by reference), and comprise two upper feed pressure rollers 21, 21*a* which are separately mounted for nipping pressure engagement against the lower feed rollers 20 (only one lower roller 20 is shown) by means of separate springs. An upper apron 23, jointly used for drafting the separate slivers 32, 32*a* of both units 3, 3*a* of the pair, is mounted for nipping pressure engagement against a lower apron 22 which rotates more quickly with respect to the circumferential speed of driven roller(s) 20 and is driven by roller 26. Two upper delivery pressure rollers 25, 25*a* are mounted for pressure engagement against driven lower delivery rollers 24 (only one lower roller is shown) of drafting arrangements 11, 11*a*, the delivery rollers having an even greater circumferential speed than the aprons 22, 23. Rollers 25, 25*a* are over-mounted and are provided with a conical facet 40 on the side opposite of their bearing. The drafting arrangements 11, 11*a* are each provided at the point where the slivers are initially fed into the drafting mechanisms with sliver feed stoppers 30, 30*a* according to EP 353 575 and U.S. Pat. No. 4,972,667, the disclosures of which are incorporated by reference.

The two upper feed supply rollers 21, 21*a* can be lifted out of nipping engagement with a driven lower feed supply roller 20 by programmably controlled pivoting of sliver stoppers 30, 30*a*. The stoppers 30, 30*a* are each attached toga lever 27, 27*a*. The levers 27, 27*a* are pivotable on a joint bearing 28 and can be actuated separately by a solenoid valve 29, 29*a* a pneumatic cylinder or other suitable actuating mechanisms. Each stopper 30, 30*a* has a duct 31 for receiving and guiding a respective sliver 32, 32*a* into the nip of the feed rollers. In the position of the solenoid 29 shown in FIG. 1, the sliver 32 is nipped at the exit from the duct 31 between the tongue-like stopper 30 and the lifted roller 21 and the roller 21 is braked, thus also stopping the supply of fibers to the air vortex nozzles 12 and thus stopping the spinning process per se.

A draw-off pressure roller 36, which is common for both spinning units 3, 3*a*, is mounted for nipping pressure engagement against the draw-off roller 35 by a pivotable lever 37 (which draw-off roller may be formed as a "continuous" roller, i.e. a cylinder that is common for all spinning units). Roller 35 has a slightly lower circumferential speed than the delivery roller 24 of the drafting arrangement. After the draw-off device 14 the two yarns 8, 8*a* each pass through a separate guide eye 17, 17*a*, subsequently through a joint eye 18 and then through a traverse mechanism 19 which brings the two spatially separate yarns 8, 8*a* into close adjacency before they are jointly wound up on the cross-wound bobbin 15. The yarns 8, 8*a* are each provided with a stop motion detector 13, 13*a* between the draw-off device 14 and the spinning nozzles 12, 12*a*, FIG. 1, or between the draw-off device 14 and the guide eyes 17, 17*a*, FIG. 2.

As shown in FIG. 1 the automatic robot 2 is movable on transport rolls 46 along the entire length of the spinning machine 1. Alternatively, the robot 2 could be provided with a drive system according to EP 300 235 instead of the rolls, i.e. it can be arranged for driving along a suspended rail system. The automatic robot 2 is automatically positioned in operational alignment with the pair of spinning units 3, 3*a* to be serviced by means of a light scanner 47, for example, which scans a positioning mark 48 on machine 1 after suitable means (not shown) have signaled to the automatic device the necessity of operational action to be taken in these spinning units. Robot 2 has an actuating member 49 which can lift or lower the lever or spinning bow 38 on which bobbin 15 is mounted by means of an arm 50, a second actuating member 51 which can lift or lower lever 37 by means of an arm 52, and a thread manipulator 53 which controllably moves two suction tubes 55, 55*a*, FIG. 2, by means of two arms 54. Suction tubes 55, 55*a* are connected to a vacuum source via tubes 56, 56*a*. The movements of the members 49, 51 and of the manipulator 53 are programmably controlled by a control device 57 provided in the robot 2. Control device 57 is connected with a control device 42 provided in the machine via a signal line 58 for communication of signals between devices 57 and 42.

During normal operation the robot 2 may be in a parked position and automatically ordered to move out of the parked position to a pair of stations to be serviced in response to a signal received from device 42 or, alternatively, the robot 2 may constantly be moving along the length of the machine patrolling the spinning stations while the two yarns 8, 8*a* of each pair of spinning units 3, 3*a* are being wound onto the respective joint bobbin 15. An exemplary sequence of automatic piecing operations as a result of a thread breakage or discontinuance in one of yarns 8 or 8*a* is as follows. For example, if one of the yarns of a pair breaks, such as yarn 8, FIG. 2, the breakage or discontinuance in yarn 8 is reported by the stop motion detector 13, FIG. 2, to the control device 42. Bobbin 15 is automatically lifted from friction roller 16 and stopped by automatic extension of a lifting beam 67 provided in the machine, the extension being effected by a pneumatic cylinder 68 in response to a signal from device 42. The details of an apparatus/method for such lifting of a bobbin from a friction roller is described in EP 128 417 and U.S. Pat. No. 4,576,342, for example, the disclosures of which are incorporated by reference herein.

Simultaneously upon detection of a thread breakage, a storage suction tube 69, over whose orifice 70 the two yarns 8, 8*a* are passed by, is automatically connected to a vacuum source via a valve (not shown). The orifice 70 of the tube 69 is disposed immediately adjacent to the course of yarn 8, 8*a* travel between eye 18 and friction roller 16. The bobbin 15 rotates sufficiently before it is actually stopped by beam 67 such that the end piece of the broken yarn 8 is wound onto bobbin 15 while, simultaneously, a loop of the unbroken yarn 8*a* which is still temporarily being produced before sliver stop 30*a* is actuated is sucked into storage tube 69. The presence of a loop of yarn 8*a* in the storage tube 69 is detected by a sensor 71 and reported to device 42.

As soon as the yarn breakage or discontinuance is reported by detector 13 to device 42, device 42 signals device 29 to actuate sliver stop 30. The sliver stop 30*a* allocated to the unbroken yarn 8*a*, however, is only actuated by solenoid 29*a* in response to a signal from device 42 only when bobbin 15 comes to a complete standstill. This ensures that only the broken yarn end is wound onto bobbin 15. Inasmuch as the time lag between the extension of beam 67 and the complete standstill of bobbin 15 depends, among other things, on the bobbin diameter, the delay time for actuating sliver stopper 30*a* is conservatively selected with a certain security margin such that a broken end of yarn 8*a* caused by the actuation of stopper 30*a* is ensured of not being wound up on bobbin 15 but rather sucked within tube 69.

The control device 42 provided in the machine signals the robot 2 to automatically move to the position of operational alignment shown in FIG. 1 as soon as pair of spinning units 3 have been operationally stopped. The automatic device 2 first operates to lift bobbin 15 by means of arm 50, such that beam 67 (e.g. according to EP 128 417 and U.S. Pat. No. 4,576,342) is retracted. Roller 36 is then lifted up out of pressure engagement with cylinder 35 by means of arm 52. Suction tube 55*a* is controllably moved to a position whereby its inlet orifice is disposed immediately adjacent to the orifice 70 of storage tube 69 by means of manipulator 53, where the end of the yarn 8*a* being stored temporarily in tube 69 is then removed and transferred by suction into tube 55*a*. The previously unbroken yarn 8*a* was broken upon actuation of sliver stop 30*a* and the end of the yarn 8*a* resulting from the breakage stored in tube 69 until transferred to tube 55*a*. This end of yarn 8*a* is threaded through eyes 18, 17*a* and the detection 13*a* by movement of manipulator 53 and tube 55*a* under the control of a program and deposited near roller 36.

Figure 3:
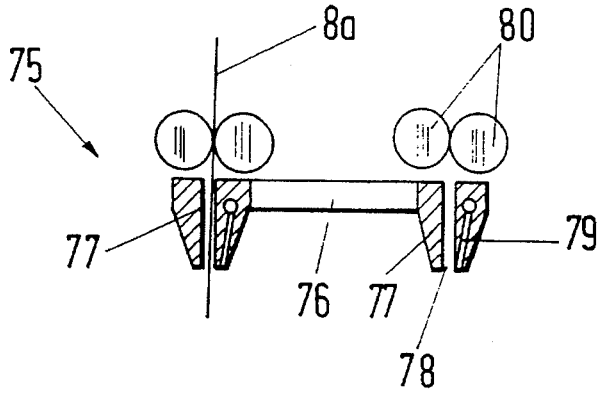
FIG. 3 is a schematic cross-sectional view of a reverse threading mechanism for use in connection with the invention.

At the end of the manipulation by manipulator 53 the end of yarn 8*a* held in tube 55*a* is transferred to a separate device 75, which is only schematically shown in FIG. 3, for reversely threading both of the yarns 8, 8*a* through the two air jet spinning nozzles 12, 12*a*. Device 75 may be similar to the device described in EP application No. 433 832, the disclosure of which is incorporated herein by reference. As shown in FIG. 3, the reverse threading device 75 has two conical pins or plugs 77 mounted on a controllably movable arm 76 for simultaneous insertion of the pins or plugs 77 into complementary receiving apertures provided at the outlet ends 100, 100*a* of air jet nozzles 12, 12*a*. The plugs 77 each have a thread receiving groove 78 which extends from a central longitudinal aperture in the center of the body of the plugs 77 radially outwardly through the outer surface of the plugs 77 such that a thread being manipulated by tubes 55, 55*a* can be routed through the grooves 78 in the outer surface of the plugs 77 into the central aperture within the body of the plugs 77. During the course of manipulation of the threads 8, 8*a* through the grooves 78, the threads are pulled into the nip of rollers 80, FIG. 3. As shown, bores 79 are provided in plugs 77 for input of compressed air which exits adjacent the lower delivery ends 81 of the central apertures within the plugs 77. Yarns 8 and 8*a*, respectively, are held in the nip line of a pair of rollers 80 and eventually reversely delivered through nozzles 12, 12*a* by controlled rotation of rollers 80 and compressed air exiting bores 79. The two pairs of rollers 80 can be driven by a common motor. First, however, it is necessary to find the broken end of yarn 8 on bobbin 15 and to return it.

During the return of the end of yarn 8*a* to device 75, the end of yarn 8 on bobbin 15 is searched for on bobbin 15 by suction funnel 83 during a slow unwinding rotation of the bobbin 15. The orifice 84 of the suction funnel 83 extends over the whole length of bobbin 15. Bobbin 15 can be controllably backwardly driven, for example, by use of a drive roller (not shown) which may be pressed onto the lifted bobbin 15 by means of an arm (not shown) carried by the robot 2. As soon as the end of yarn 8 is retrieved, which is reported by a sensor 85 in funnel 83, the yarn end is transferred to suction tube 55 from orifice 84 and is guided to device 75 in the same manner as described for the transfer of the end of yarn 8*a*. When both yarns 8, 8*a* have been reversely threaded into device 75 and grasped by the pairs of rollers 80, the two yarns 8, 8*a* are cut off adjacent to the front ends 81 of pins 77 and said pins 77 are controllably moved into insertion in the complementary receiving apertures at the outlet ends 100, 100*a* of nozzles 12, 12*a*. As soon as the two yarns 8, 8*a* are reversely threaded through nozzles 12, 12*a*, they are grasped again at the inlet ends 110, 110*a* of nozzles 12, 12*a* by the inlet orifices of suction tubes 55, 55*a* which have been controllably displaced in the meantime by manipulator 53. Suction tubes 55, 55*a* are then subsequently moved around rollers 25, 25*a* to a position where the orifices of tubes 55, 55*a* are holding the ends of yarns 8, 8*a* behind rollers 25, 25*a* in the position shown in FIG. 2.

During the process of retrieval and return of the broken end of yarn 8 to device 75, yarn 8*a* is naturally also drawn off from bobbin 15. This "over-length" of yarn 8*a* is collected in a waste chamber connected with suction tube 55*a* which is suctionally holding the end of yarn 8*a* during and after its manipulation through groove 78. The waste caused by the cutting to length of the yarns 8, 8*a* by device 75 is also collected in respective waste chambers connected to manipulation suction tubes 55, 55*a*.

Figure 4:
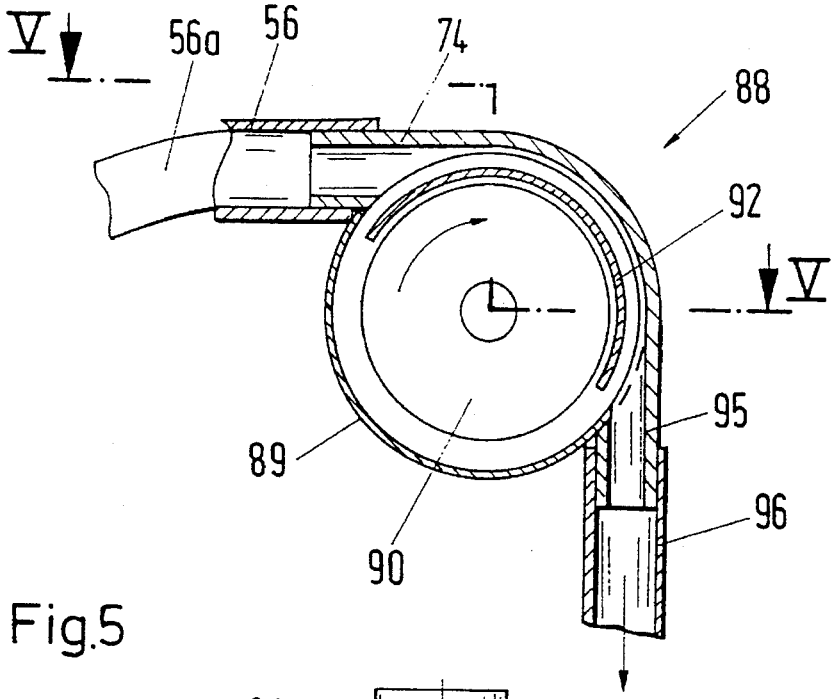
FIG. 4 is a cross-sectional view through a mechanism for establishing and preparing a thread end of a spun yarn reversely fed through the spinning mechanism in preparation for eventual overlap and piecing with the end of a sliver.
Figure 5:
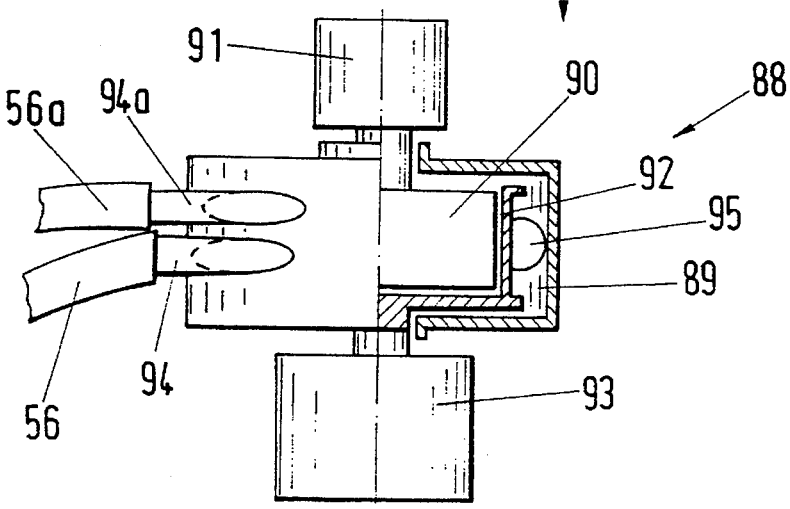
FIG. 5 is a sectional view along lines V—V in FIG.

Now the ends of yarns 8, 8*a* are cut to length and frayed. Device 88 as shown in FIGS. 4 and 5 is used for this purpose and is similar to the device disclosed in U.S. application Ser. No. 07/986,595 filed Dec. 7, 1992, the disclosure of which is incorporated herein by reference. As shown, device 88 comprises a cylindrical casing 89 in which a cylindrical abrasive disc 90 is rotatably mounted. The abrasive disc 90 can be driven by a motor 91. The housing 89 of disc 90 is at least partly (e.g. half) covered by a bow-shaped bell 92 which can be rotated by one full rotation from the position as shown in FIG. 4 by a motor 93, the rotation being initiated by an appropriately timed signal from control unit 57. Two nozzles 94, 94*a* open out tangentially into the housing adjacent to one another. The two tubes 56, 56*a* are attached to nozzles 94*a*. A suction nozzle 95 is sealably connected to the housing offset by approx. 90° with respect to nozzles 94, 94*a*. Nozzle 95 is connected to suction pump via a tube 96. The two tubes 56, 56*a* are of different length. In the position as shown in FIG. 4, the cover or bell 92 shields the surface of the grinding roller 90 from the overlying passage 120 extending between the nozzle 94 and the suction nozzle 95.

The ends of yarns 8, 8*a* are reversely conveyed by pairs of rollers 80 through air vortex nozzles 12, 12*a* with the aid of compressed air blowing from bores 79 reversely through the nozzles. Upon emergence from the inlet ends 110, 110*a* of the nozzles, yarn ends 8, 8*a* are captured by suction tubes 55, 55*a* and sucked through passage 120 around bell 92 until they reach the joint nozzle 95 through tubes 56, 56*a*. The above-mentioned waste chamber is connected downstream to nozzle 95. The yarn length and the strength of the suction in tube 96 defines the tensile force acting on yarns 8, 8*a*. In order to cut yarns 8, 8*a* to length and to fray them, motors 91, 93 are switched on such that shield 92 is rotated and the tensioned yarns 8, 8*a* briefly come in contact with the rotating abrasive disc 90 and are severed and frayed.

In this manner the yarns are cut and processed accordingly (frayed). Owing to the different length of tubes 56, 56*a*, the yarn lengths stored in the tubes 56, 56*a* are also different.

For joining yarns, 8*a* to slivers newly supplied by the drafting arrangements 11, 11*a*, the two arms 50, 52, FIG. 1, are lowered starting out from the position as shown in FIG. 1, such that the yarns 8, 8*a* are simultaneously withdrawn forwardly through nozzles 12, 12*a* at the same rate by draw-off shaft 35 and jointly wound onto bobbin 15. In order to compensate for the initially slower acceleration of bobbin 15 up to the full operating speed, two suction storage tubes 98 may be provided in the automatic device between eyes 17, 18 and 17*a*, 18*a* so as to preliminarily store yarn loops temporarily until the bobbins operate at full circumferential speed. Suction tube 69 can also be used for this purpose.

At the same time the two tubes 55, 55*a* are swivelled apart, so that the yarns 8, 8*a* which are tensioned between the orifices of the tubes and the entries 110, 110*a* into the nozzles 12, 12*a*, reach the nip line between the upper 25, 25*a* and lower 24 delivery rollers (only one lower roller shown). The two solenoids 29, 29*a* are successively switched off in a predetermined time delayed sequence such that a new end of the slivers 32, 32*a* newly conveyed by the cylinder 20 and the aprons 22, 23 arrive at the lower delivery roller 24 when the respective frayed ends of the yarns 8, 8*a* arrive there too. Owing to the different lengths of tubes 56, 56*a* and the different lengths of yarns stored therein, the switch-off times of solenoids 29, 29*a* are different, such that the sliver stream is joined at the frayed yarn end in any case. Due to the different yarn lengths it is ensured, however, that the time at which the end of yarn 8 is joined with a new sliver end and the time at which the end of yarn 8*a* is joined with a new sliver end is different. The ends are eventually withdrawn into the nozzles 12, 12*a* and pieced at different times and thus at different positions along the longitudinal lengths of the two yarns. The joining positions of the two yarns 8, 8*a* along the longitudinal lengths of the yarns are thus offset to one another. Thus after subsequent twisting process, hardly any thickened positions are noticeable in the twist at the joined positions. The drawing off or joint winding of the two yarns 8, 8*a*, however, can nevertheless be begun at the same time for both yarns 8, 8*a*.

The joining per se can be made according to a method of CH 2223/91 of Jul. 25, 1991 or CH 1997/92 of Jun. 25, 1992, the disclosures of which are incorporated herein by reference.

Alternatively it is also possible to use two storage tubes 69 in the machine downstream of the eye 18 instead of the one storage tube 69. Storage tubes 98 provided in the automatic device can be dropped in this case. Depending on the type of the yarns 8, 8*a* to be produced it may also be suitable to provide each storage tube 55, 56 or 55*a*, 56*a*, respectively, with its own cross-cutting device 80, which in this case only has one single nozzle 94. Bell 92 can also be moved axially for releasing abrasive disc 90 and may then be arranged cylindrically so as to surround the abrasive disc.

If the lateral distance of ducts 31 can be kept small with respect to one another, it is possible under certain circumstances to use only a single joint output pressure roller 25 of drafting arrangements 11, 11*a* and to deposit the two yarns 8, 8*a* from the same side behind said pressure roller.

A yarn manipulator for use in an automatic joining device has been shown (for ring spinning) in PCT patent application WO 90/7599. Said manipulator can be adapted for use in an automatic device in accordance with the present invention In the example according to FIG. 1 one suction tube is provided per yarn. The system could be controlled in such a manner that these suction tubes are "allocated" to the yarns and operate depending on the stop motion 13, 13*a* responsive to the yarn breakage, so that every suction tube can be guided for receiving the yarn end wound onto the bobbin or for receiving the yarn end held in the storage 69. Every suction tube therefore always collects its "own" yarn 8, 8*a*, irrespective of which yarn breaks first. The manipulators, however, can be controlled in such a manner that a specific suction tube takes up the yarn from storage 69 and the other suction tube takes up the yarn end from the bobbin. In this case it is not possible to produce either of the yarns form a predefined feed 10 or 10*a*.

For simplicity's sake an embodiment with only two suction tubes 55, 55*a* has been shown and described. The tasks attributed to said suction tubes could, however, partly be divided among further manipulators, e.g. a manipulator could be provided for threading eyes 17, 18, whereupon the threaded yarn 8 or 8*a* could be transferred to a suction tube 55, 55*a*.

Because of the catching of the unbroken yarn in storage 69 it is possible to avoid the search for the two yarns on bobbin 15. Such a search process would have to provide the separation of the yarn pair, as they could hardly be found separately. Furthermore, it is possible to keep the yarns (broken/unbroken) apart, so that they can be joined to the respectively predefined feeds 10, 10*a*, which would be preferable in "mixed yarns".

If both yarns 8, 8*a* should exceptionally break simultaneously or instantly after each other, sensor 71 does not respond after the stopping of bobbin 15. In this case device 42 sends a signal to an operator that a manual search of at least the one yarn end on bobbin 15 is required.

In accordance with the invention other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. In a yarn spinning machine having a pair of spinning mechanisms simultaneously spinning first and second yarns from first and second supplies of slivers wherein the first and second spun yarns are wound up jointly on a single bobbin, a method for restarting spinning operations in the pair of spinning mechanisms upon a breakage or discontinuance in one of the yarns being spun, the method comprising:

stopping the supplies of slivers after an occurrence of a breakage or discontinuance in one of the two yarns being spun;

retrieving an end of each of the firsthand second spun yarns and reversely routing the retrieved first and second yarn ends through the first and second spinning mechanisms;

capturing the first and second yarns after the reverse routing at an inlet to the first and second spinning mechanisms;

establishing one yarn length between an end of the first yarn and the inlet to the first spinning mechanism and establishing another different yarn length between an end of the second yarn and the inlet to the second spinning mechanism;

simultaneously withdrawing the first and second yarns forwardly through the first and second spinning mechanisms at the same rate of withdrawal; and, joining the ends of the first and second yarns with a restarted end of each of the first and second silver supplies as the yarns are being withdrawn and before the ends of the yarns are withdrawn through the spinning mechanisms;

the joined ends of the reversely routed yarns being withdrawn forwardly into the first and second spinning mechanisms at different times during withdrawal.

2. The method of claim 1 wherein the ends of the yarns are joined at the same distance from the inlet ends of the first and second spinning mechanisms, the first and second sliver supplies being restarted at different times such that the ends of the restarted sliver supplies respectively join with the ends of the first and second yarns at different times at the same distance from the inlet ends.

3. The method of claim 1 wherein the end of the one yarn in which a breakage or discontinuance occurs is wound up on the bobbin after the breakage or discontinuance and wherein the one yarn end wound up on the bobbin after the breakage is retrieved from the bobbin separately from retrieval of the end of the other yarn.

4. A yarn spinning machine comprising first and second spinning mechanisms spinning first and second yarns, a draw off mechanism withdrawing the first and second yarns from the spinning mechanisms and delivering the drawn off yarns to a common bobbin, the yarns being wound up simultaneously on the bobbin mechanism, and a suction tube having an orifice disposed along the length of the yarns being commonly wound up on the bobbin, the suction tube drawing a loop of one of the yarns into the tube and storing the loop upon a breakage or discontinuance in the other yarn being spun, the machine further comprising a piecing control mechanism, the piecing control mechanism stopping the bobbin after the breakage such that the yarn stored in the suction tube is not wound up on the bobbin, an end of the yarn stored in the suction tube being established after the breakage or discontinuance in the other yarn occurs, the spinning machine further comprising first and second yarn end length mechanisms disposed upstream of the first and second spinning mechanisms, the first yarn end length mechanism establishing one yarn end length for withdrawal and piecing of one spun yarn and the second yarn end length mechanism establishing a second different yarn end length for withdrawal and piecing of the other spun yarn.

5. The apparatus of claim 4 wherein the other yarn has a broken end upon a breakage or discontinuance and the broken end is wound up on the bobbin upon the breakage or discontinuance.

6. In a yarn spinning machine comprising a pair of spinning mechanisms simultaneously spinning first and second yarns from first and second sliver supplies having first and second sliver stop mechanisms, wherein the spun yarns are wound up jointly on a common bobbin, a method for simultaneously re-starting spinning of the first and second yarns upon an unintentional breakage in one of the yarns being spun, the method comprising:

stopping the sliver supplies after the unintentional breakage of the one yarn, the one yarn having a broken end upon the occurrence of breakage;

winding the broken end of the one yarn up on the bobbin and storing a loop of the other yarn in a suction storage tube after the breakage in the one yarn;

retrieving the broken end of the one yarn from the bobbin and retrieving an end of the other yarn stored in the suction storage tube;

reversely routing the retrieved ends of the first and second yarns through the first and second spinning mechanisms;

separately capturing the reversely routed yarns at an inlet to the first and second spinning mechanisms in first and second suction tubes;

storing a first selected length of the first yarn in the first suction tube and storing a second different selected length of the second yarn in the second suction tube;

simultaneously withdrawing the first and second yarns forwardly through the spinning mechanisms at the same rate of withdrawal; and, joining an end of the first and second yarn lengths with a restarted end of the silver supplies as the yarns are being withdrawn and before the joined ends of the yarn lengths are withdrawn into the spinning mechanisms;

the joined ends of the yarn lengths being offset from each other along the longitudinal lengths of the yarns during simultaneous withdrawal.

7. The method of claim 6 wherein the yarns being simultaneously withdrawn are jointly wound up on the bobbin such that the joined ends of the yarns are offset from each other along the longitudinal lengths of the yarns as the yarns are wound up.

8. Apparatus for simultaneously restarting yarn spinning of a pair of yarns being separately spun and jointly would up on a common bobbin upon a breakage in one of the yarns, the apparatus comprising:

a yarn spinning machine having a pair of spinning mechanisms spinning first and second yarns from first and second sliver supplies, the spun yarns being withdrawn from the spinning mechanisms by a draw-off mechanism and delivered to a common bobbin which jointly winds the yarns up; the yarn spinning machine including first and second yarn breakage detectors disposed adjacent the path of a respective spun yarn downstream of the spinning mechanisms and first and second sliver supply stop mechanisms which stop the sliver supplies after detection of a breakage in one of the yarns being spun, both yarns being unwound from the bobbin and an end of each of the yarns being retrieved and reversely routed through the draw-off mechanism and through the first and second spinning mechanisms after the breakage in the one yarn;

the apparatus further comprising a robot having first and second suction tubes capturing the reversely routed yarn ends at an inlet to the first and second spinning mechanisms, the first suction tube storing a first selected length of the first reversely routed yarn and the second suction tube storing a second selected length of the second reversely routed yarn, the stored lengths of the reversely routed yarns being different in length;

the draw-off mechanism withdrawing the stored lengths of yarn at the same rate from the suction tubes and through the spinning mechanisms;

an end of each of the stored lengths of the different yarns being joined with a restarted end of the first and second sliver supplies before the ends of the stored lengths of yarn are withdrawn through the spinning mechanisms.

9. The apparatus of claim 8 wherein the suction tubes each include a cutting mechanism mounted at first and second different distances along the lengths of the suction tubes, the ends of the yarns captured by the suction tubes being sucked past the cutting mechanisms, the cutting mechanisms cutting the yarns sucked past the cutting mechanisms and establishing the first and second different stored lengths of yarn in the suction tubes for withdrawal and joining.

10. The apparatus of claim 8 wherein the machine includes a sliver drafting mechanism into which the sliver supplies are commonly fed and delivered to the spinning mechanisms, the drafting mechanism being disposed upstream of the spinning mechanisms and including first and second pairs of feed rollers into which the first and second sliver supplies are separately fed.

11. The apparatus of claim 10 wherein the first and second stop mechanisms stop the sliver supplies by lifting one roller of each feed roller pair out of nipping engagement with the other roller of each feed roller pair.

12. The apparatus of claim 8 wherein the machine includes a storage suction tube having an orifice disposed closely adjacent to the first and second yarns between the draw-off mechanism and the bobbin, the storage suction tube being actuated to suck in a loop of the other yarn after a breakage in the one yarn.

13. The apparatus of claim 12 wherein the machine includes a control mechanism actuating a discontinuance in driven wind-up by the bobbin after the breakage in the one yarn and actuating one of the stop mechanisms to stop the sliver supply to the other yarn after the discontinuance in driven wind-up by the bobbin is actuated.

* * * * *